US005228225A

United States Patent [19]

Lee

[11] Patent Number: 5,228,225

[45] Date of Patent: Jul. 20, 1993

[54] PROGRESSIVE LIQUID DISPLAY DEVICE

[76] Inventor: Vincent K. W. Lee, No. 44, Lane 458, Sheh Chung St., Taipei, Taiwan

[21] Appl. No.: 784,511

[22] Filed: Oct. 29, 1991

[51] Int. Cl.[5] ..... G09F 19/00

[52] U.S. Cl. ..... 40/409; 40/439; 446/267; 446/489

[58] Field of Search ..... 40/409, 410, 406, 439, 40/445, 427, 491; 446/267, 489, 168, 169; 472/65, 67, 68

[56] References Cited

U.S. PATENT DOCUMENTS

| | | | |
|---|---|---|---|
| 4,034,493 | 7/1977 | Ball | 40/406 |
| 4,057,921 | 11/1977 | Ball | 40/406 |
| 4,662,627 | 5/1987 | Utley | 472/67 |
| 4,731,945 | 3/1988 | Howard | 40/491 |
| 4,837,957 | 6/1989 | Egender | 40/491 X |
| 4,864,752 | 9/1989 | Kent | 40/439 X |
| 4,939,859 | 7/1990 | Bradt | 40/439 X |
| 4,944,969 | 7/1990 | Usui | 40/409 X |

*Primary Examiner*—James R. Brittain
*Assistant Examiner*—Milton Nelson, Jr.
*Attorney, Agent, or Firm*—Bacon & Thomas

[57] ABSTRACT

A progressive liquid display device comprising a plurality of display strips movably held in a liquid between plural pairs of symmetrical grooves behind a transparent wall, the symmetrical grooves each having a stop plate fastened therein to confine the moving range of the corresponding display strip. The display strips will sink or float when the device is turned upside down and be stopped by the stop plates with one strip rising behind another to form a desired pattern.

5 Claims, 11 Drawing Sheets

PROGRESSIVE LIQUID DISPLAY DEVICE

BACKGROUND OF THE INVENTION

The present invention relates to a progressive liquid display device in which a plurality of display strips will automatically move into place in proper order with one rising behind another to show a pattern when the device is turned upside down.

Several liquid display ornaments have been known. FIG. 1 illustrates a liquid-filter ornament as constructed according to the prior art. FIG. 2 illustrates a floating ornament which can be simultaneously used as a paper weight. In FIG. 3 there is illustrated a color phase changeable liquid display ornament. In FIG. 4 there is illustrated another type of liquid display ornament which comprises a toy boat floating on a liquid contained in a transparent display container. The present invention provides a completely new structure for a liquid display device.

SUMMARY OF THE INVENTION

According to one aspect of the present invention, a progressive liquid display device is generally comprised of a plurality of thin, elongated, narrow strips sinking or floating on a liquid contained in a casing behind a transparent wall thereof. The thin, elongated, narrow strips are guided to move along a plurality of symmetrical pairs of grooves on the inner wall surface of the casing at two opposite sides in a longitudinal direction. Stop plates are respectively fastened in the grooves at different levels to limit the moving range of the thin, elongated, narrow strips. Turning the casing upside down causes the thin, elongated, narrow strips to sink or float upwards and be stopped by the stop plates respectively so that the thin, elongated, narrows trips can form into a series of strips with one rising behind another for showing a pattern behind the transparent wall.

DETAILED DESCRIPTION OF THE PREFERRED EMBODIMENT

Figure 1:
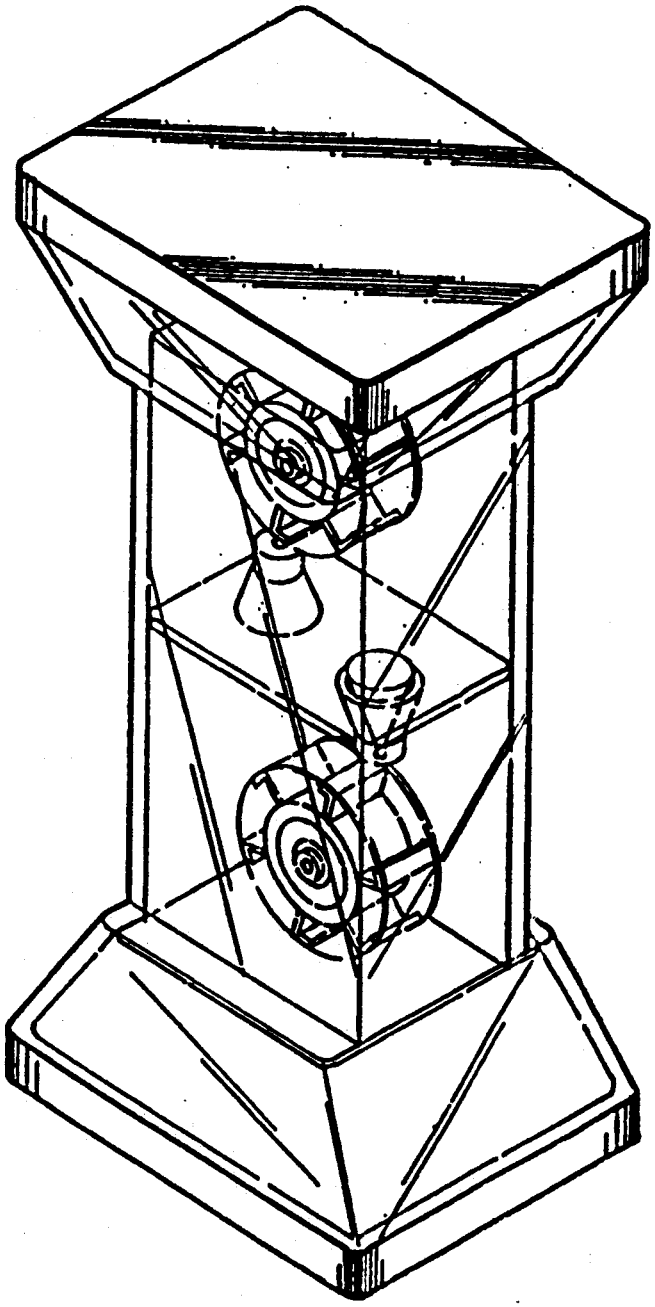
FIG 1 Prior art
FIG. 1 illustrates a liquid-filter ornament as constructed according to the prior art.
Figure 2:
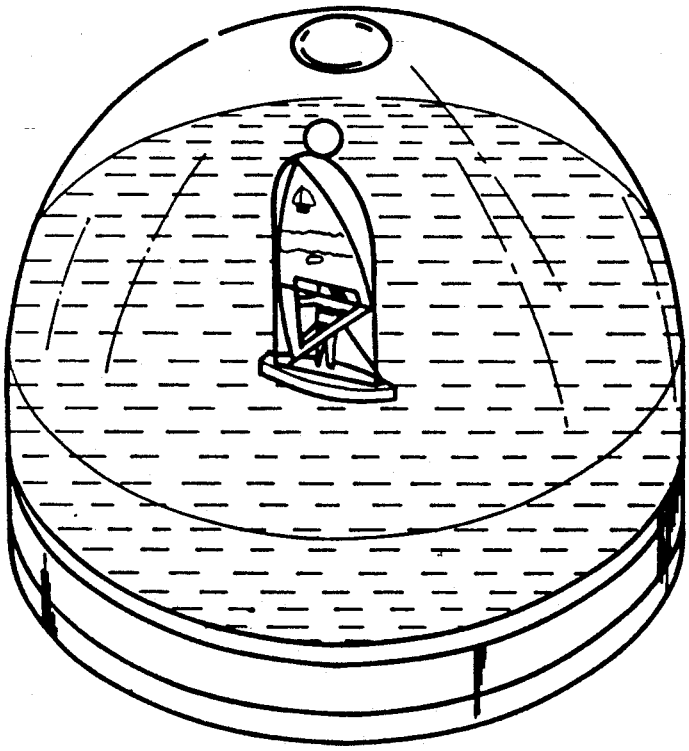
FIG 2 Prior art
FIG. 2 illustrates a floating ornament as constructed according to the prior art.
Figure 3:
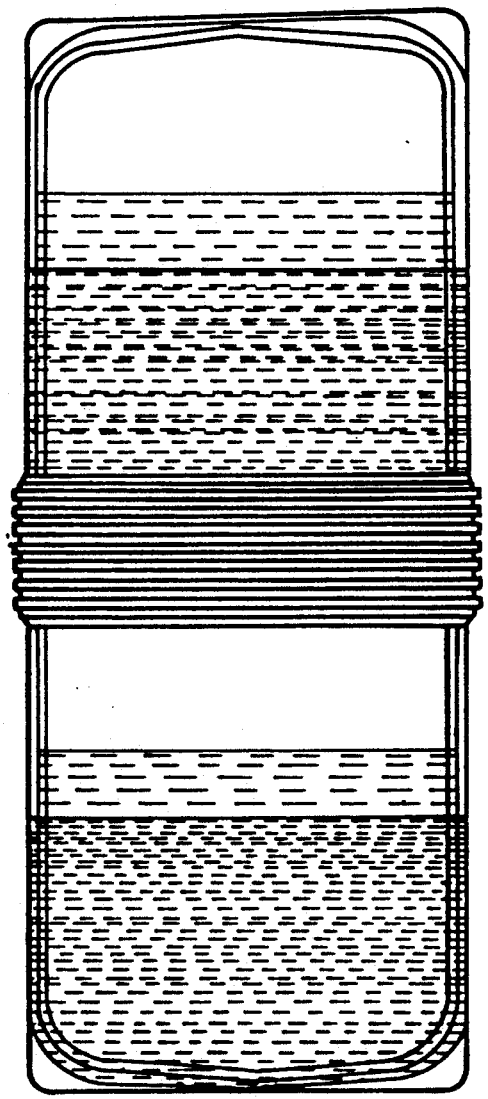
FIG 3 Prior art
FIG. 3 illustrates various ornamental liquid container devices according to the prior art.
Figure 4:
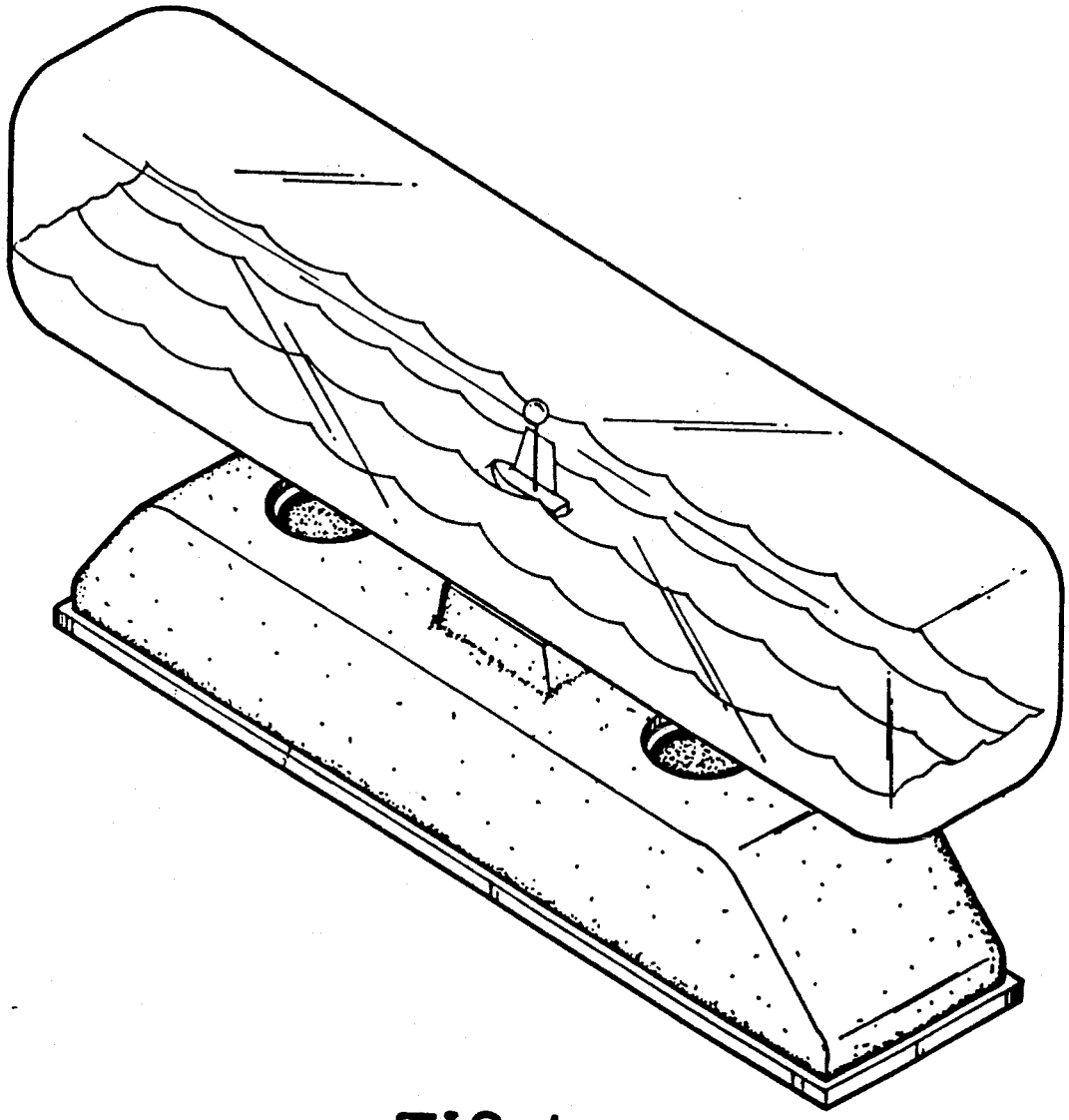
FIG 4 Prior art
FIG. 4 illustrates another type of liquid ornament according to the prior art in which a toy boat is floating on a liquid contained in a transparent display container.
Figure 5:
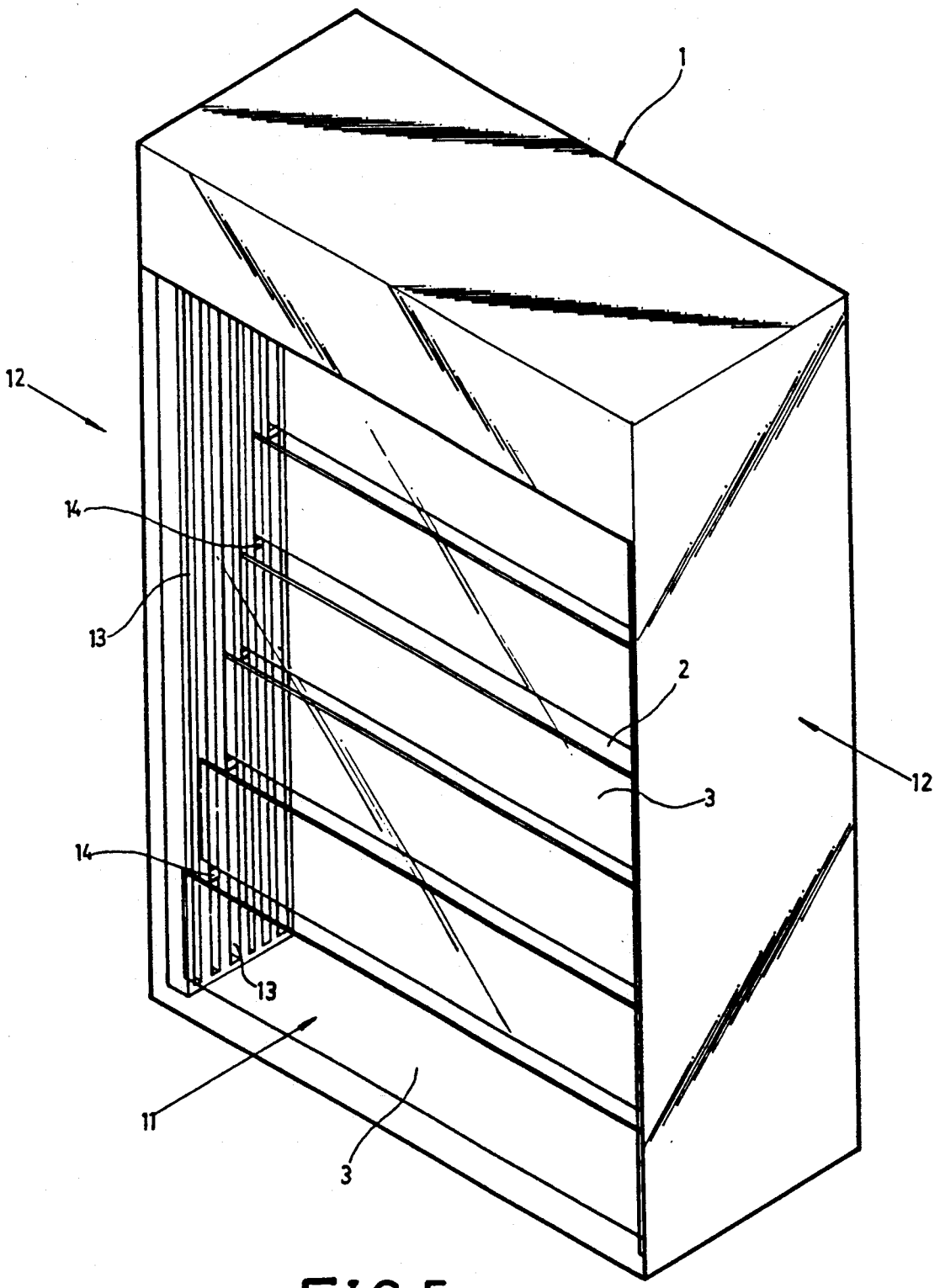
FIG. 5 is a perspective view of a progressive liquid display device as constructed according to the present invention.
Figure 6:
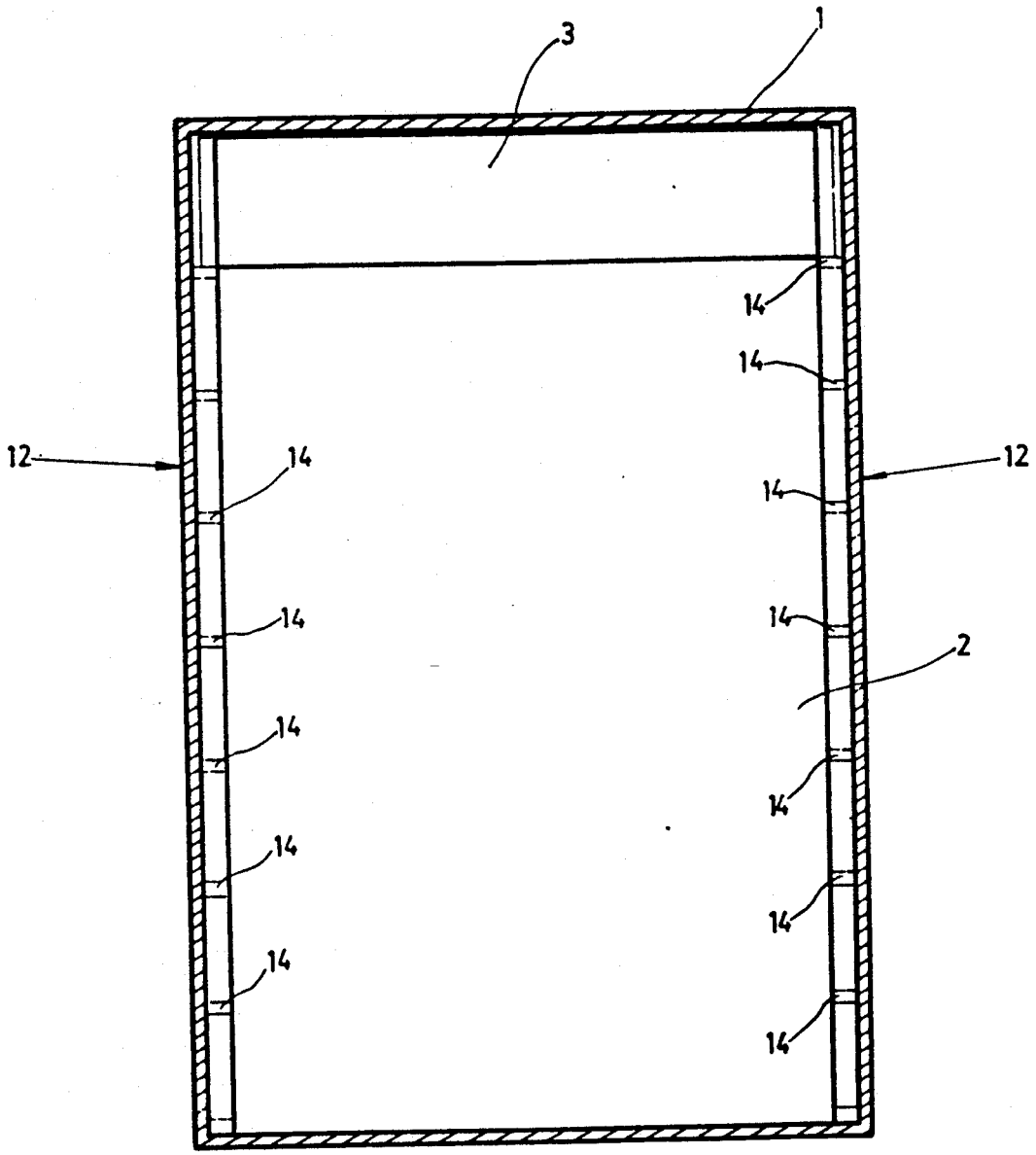
FIG. 6 is a sectional front view of the liquid display device of the present invention.
Figure 7:
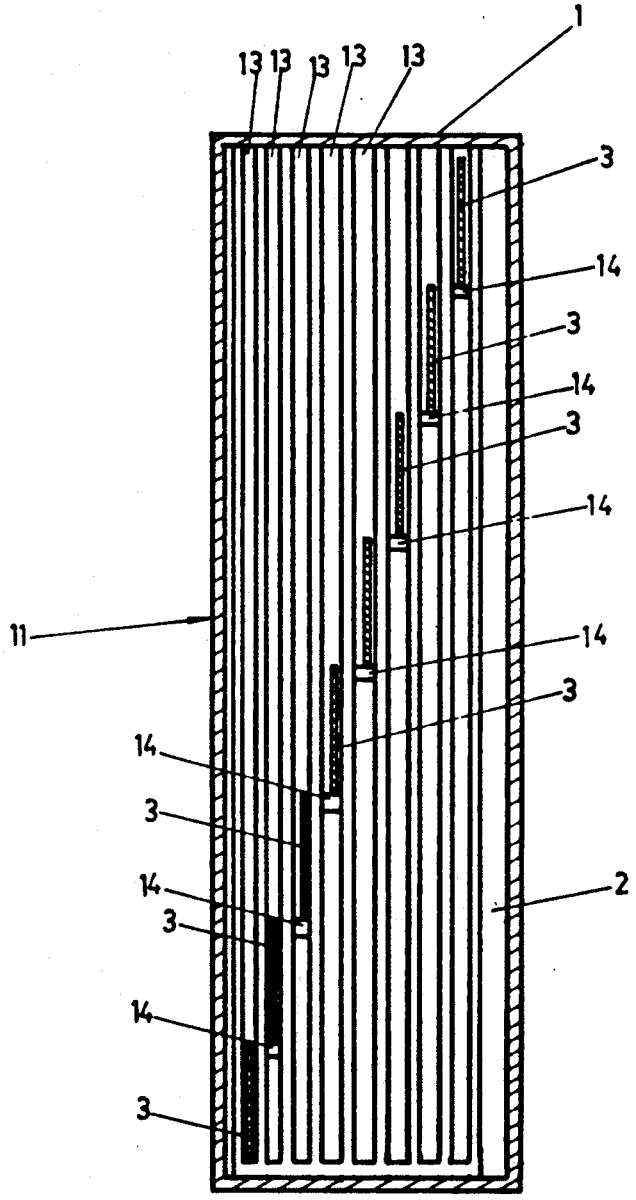
FIG. 7 is a sectional side view of the liquid display device of the present invention.

Referring to FIGS. 5, 6 and 7, a liquid display device as constructed in accordance with the present invention is generally comprised of a hollow, enclosed casing 1 with a liquid 2 and a plurality of display strips 3 contained therein. The casing 1 can be turned upside down and comprises at least one transparent side wall 11 for looking at the inside, two opposite side walls 12 at right angles relative to said at least one transparent side wall 11, and a plurality of symmetrical pairs of longitudinal grooves 13 formed on inner sides of said two opposite side walls 12. The display strips 3 are made in equal length so that they can be movably fastened in the parallel grooves 13 and retained between the two opposite side walls 12. The actual length and thickness of the display strips 3 must be properly made so that they move up and down between each symmetrical pair of grooves 13. Further, there are a plurality of stop plates 14 fastened in the symmetrical pairs of grooves 13 at different levels to respectively stop the display strips 3 from moving downwards, and therefore, the display strips 3 are formed into a series of steps with one rising behind another when they are stopped by the stop plates 14. The surfaces of display strips 3 may be separately printed with segments of a pattern in proper order. As soon as the display strips 3 are all moved into their respective positions, a complete pattern is formed thereby and shown through the transparent wall 11.

The display strips 3 may be made from a photographic film or the like, which will sink in the liquid. The liquid 2 is preferably of the kind having a specific gravity higher than that of water so that the display strips 3 will sink therein slowly. Further, the grooves 13 and the display strips 3 shall be properly made so that the display strips 3 can smoothly move downwards along the grooves 13 when the casing 1 is turned upside down. The printings on the surfaces of display strips 3 may be formed into a pattern, drawing or a series of characters. When all the display strips 3 are maintained in place, they show the whole pattern, drawing or series of characters.

Figure 8:
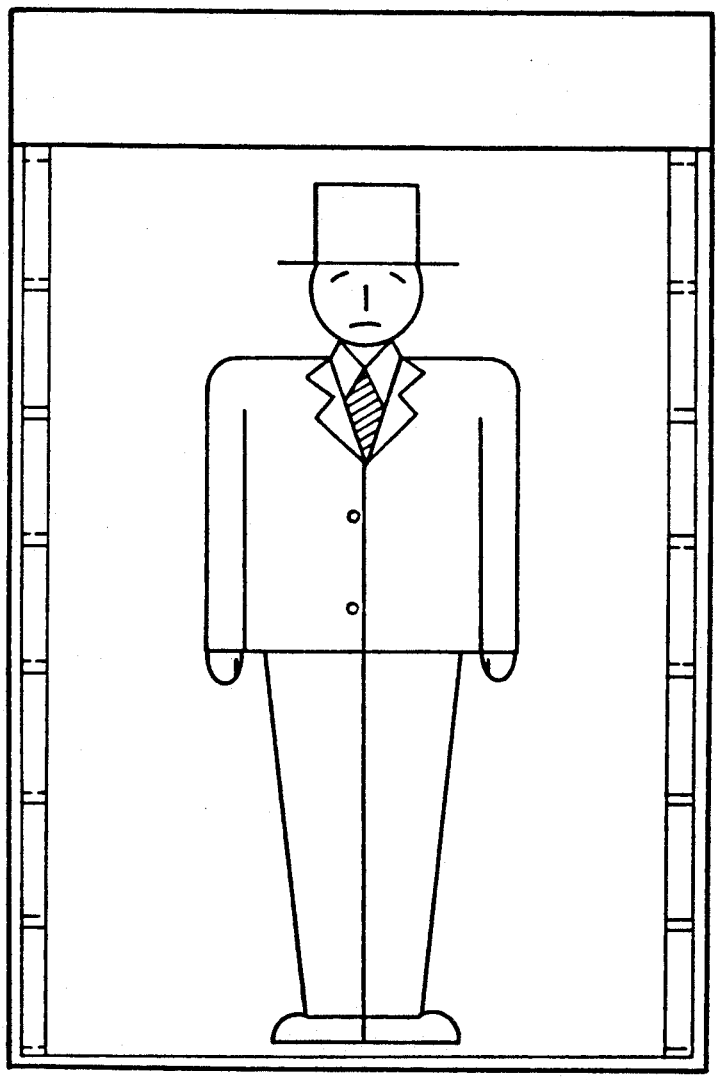
FIG. 8 illustrates an example of a pattern shown on the display strips according to the present invention.
Figure 9:
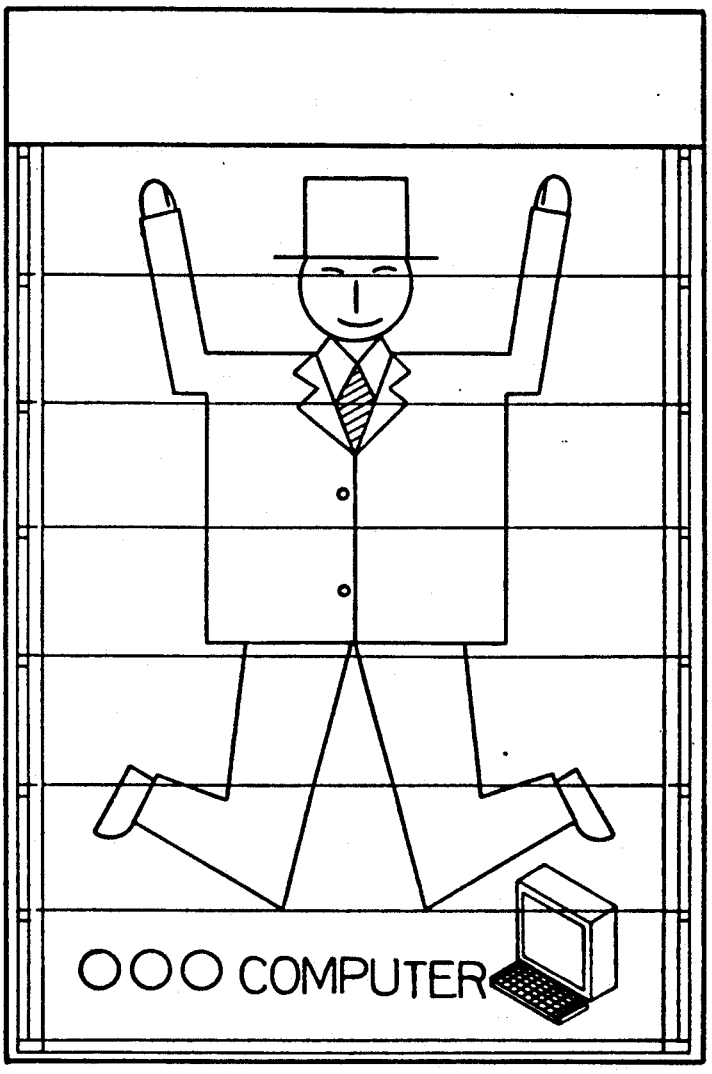
FIG. 9 illustrates another example of a pattern shown on the display strips according to the present invention.

Referring to FIGS. 8 and 9, there are illustrated two patterns examples shown on the display strips. These two liquid display devices can be shown with one after the other for commercial purpose. The pattern in FIG. 8 shows that a person is greatly crestfallen while the pattern in FIG. 9 shows that the person is greatly encouraged because a favorite thin is presented.

Further, the width of the grooves 13 and the pitch therebetween must be as short as possible so that the pattern segments on the display strips 13 can be closely shown together to form a whole pattern or drawing or series of characters. The two side walls 12 can be opaque and the casing 1 can be made in a slightly tilted structure so that the pattern segments on the display strips 13 will not be greatly segregated from one another and can than be integrally shown. Further, by changing the specific gravity of the liquid 2 relative to the display strips 3, the display strips 3 may float and move upwards in the liquid 2 when the casing 1 is turned upside down.

Figure 10:
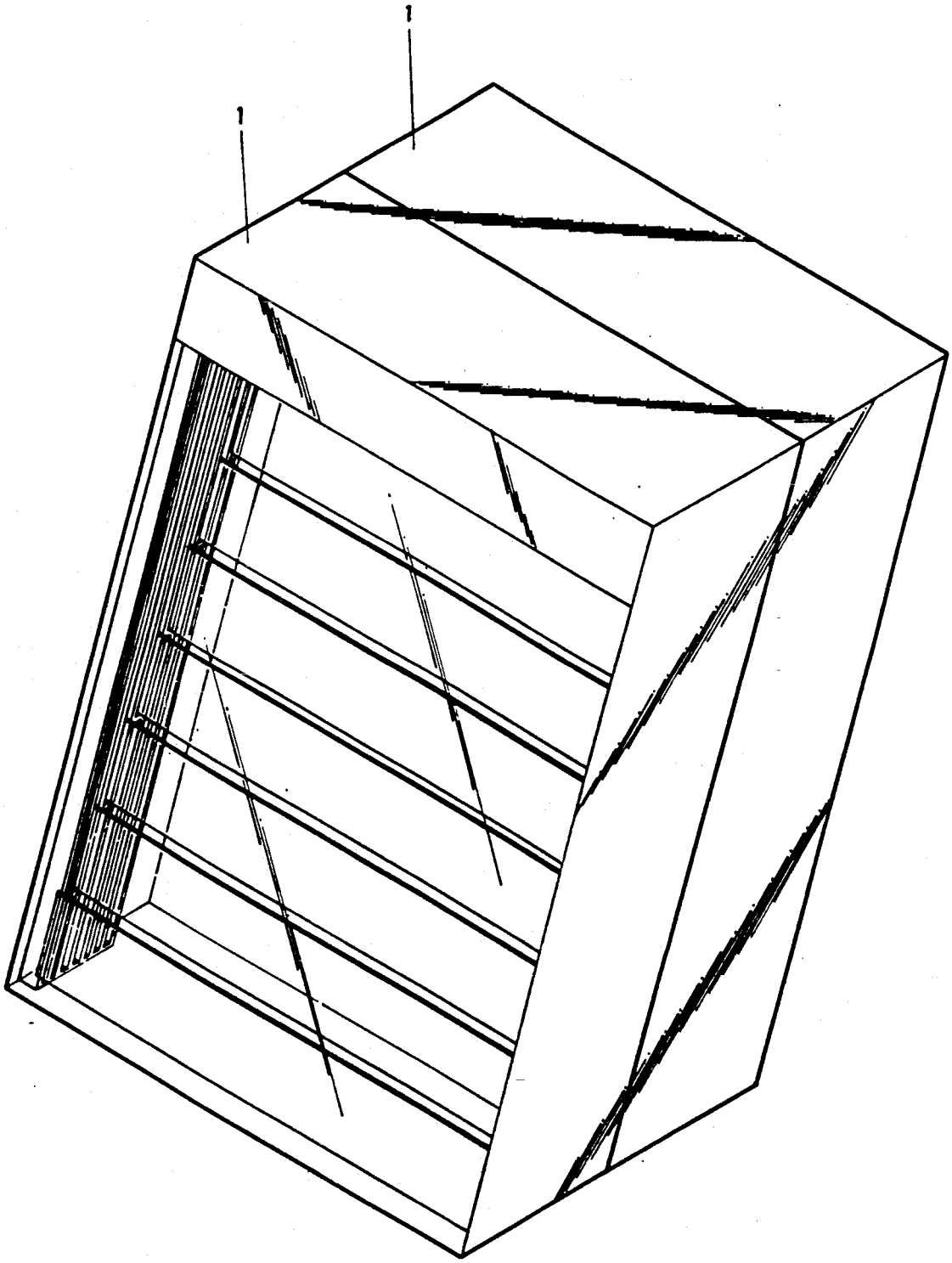
FIG. 10 illustrates a double-face liquid display device as constructed according to the present invention.

FIG. 10 illustrates an alternate form of the present invention in which two liquid display devices are attached together back to back, forming a double-face liquid display device.

Figure 11:
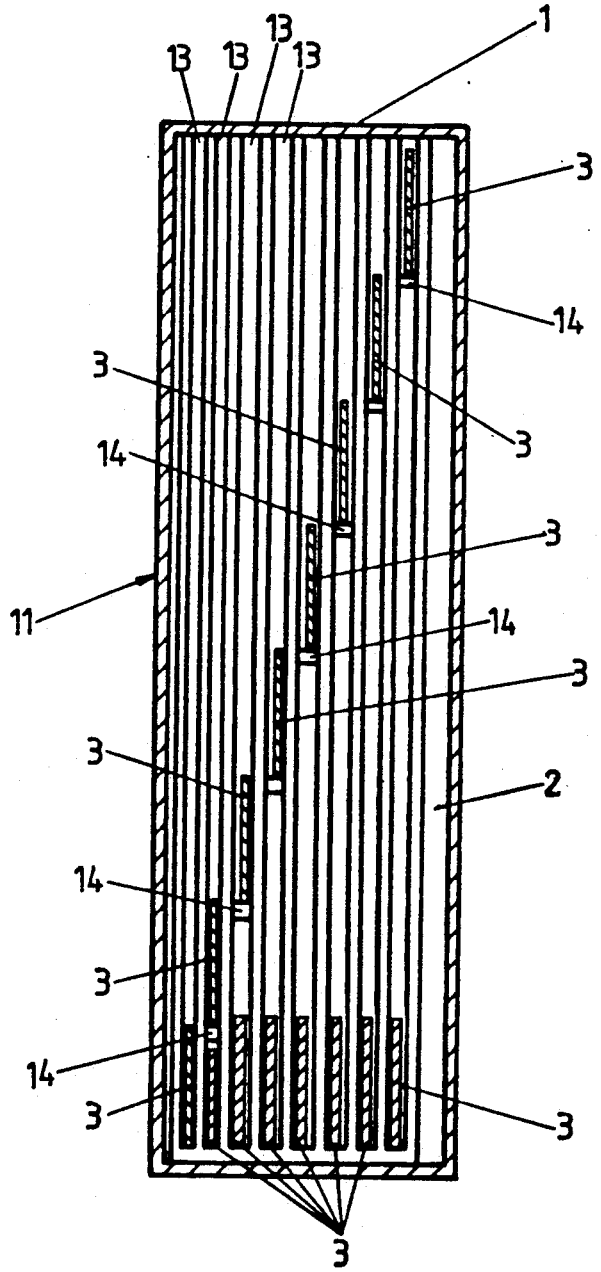
FIG. 11 illustrates another alternate form of the present invention.

FIG. 11 illustrates sill another alternate form of the present invention in which two sets of display strips 3 are inserted in each symmetrical pair of grooves 13 at two opposite ends relative to the stop plate 14 therein, namely, two sets of display strips 3 are fastened in each opposed pair of symmetrical grooves 13 on the two opposite side walls 12 of the casing 1. Therefore, when the casing 1 is turned upside down, another pattern is shown on the other set of display strips 3. When two liquid display devices are incorporated into a double-face liquid display device, total four different patterns can be shown.

What is claimed is:

1. A progressive liquid display device comprising:

a) an enclosed casing with a liquid contained therein, the casing including at least one transparent wall for viewing the contents of the casing, two opposed sidewalls at right angles to the transparent wall, each side wall including an inner side provided with a plurality of vertical grooves, and at least one stop plate disposed in each vertical groove at a predetermined position;

b) a plurality of narrow strips disposed within the casing, each narrow strip including a pair of opposed ends and at least one display surface for carrying a printing thereon, the opposed ends of each narrow strip being engaged within a pair of vertical grooves of the side walls for movement therealong; and c) when the casing is turned upside down, the narrow strips are displaced along the vertical grooves until they engage the stop plates to terminate the displacement of the narrow strips at the predetermined positions for permitting the formation of a complete pattern from the printings on the display surfaces of the strips.

2. The progressive liquid display device of claim 1 wherein the liquid has a sufficient specific gravity to permit the narrow strips to float vertically therein when the casing is turned upside down.

3. The progressive liquid display device of claim 1 wherein the liquid has a sufficient specific gravity to permit the narrows strips to sink therein when the casing is turned upside down.

4. The progressive liquid display device of claim 1 further including a pair of casings secured together with each casing including an outwardly facing transparent wall.

5. The progressive liquid display device of claim 1 further including two narrow strips engaged within a pair of vertical grooves.

* * * * *